United States Patent [19]

Moore

[11] 3,944,654

[45] Mar. 16, 1976

[54] BALANCE BEAM TRAINING APPARATUS

[76] Inventor: William J. Moore, 31 Tall Oaks, Suffern, N.Y. 10901

[22] Filed: Dec. 14, 1973

[21] Appl. No.: 424,734

[52] U.S. Cl. ..... 272/60 R; 273/1 R

[51] Int. Cl.[2] ..... A63B 1/02

[58] Field of Search ..... 272/60 R, 57 R, 59 R, 1 R; 273/1 R; 46/26; 403/174, 217, 218, 353, 348

[56] References Cited

UNITED STATES PATENTS

| | | | |
|---|---|---|---|
| 6,451 | 2/1849 | Brooke | 403/348 |
| 1,155,273 | 9/1915 | Quade | 273/136 H |
| 3,339,920 | 9/1967 | Moritz | 272/60 R |
| 3,536,327 | 10/1970 | Kaehne | 272/59 R |
| 3,632,109 | 1/1972 | Dattner | 272/60 R |
| 3,761,084 | 9/1973 | Dieckmann | 272/60 R |
| 3,837,644 | 9/1974 | Stinchcomb | 272/60 R |

FOREIGN PATENTS OR APPLICATIONS

| | | | |
|---|---|---|---|
| 924,167 | 1955 | Germany | 272/60 R |

*Primary Examiner*—Jerome Schnall
*Assistant Examiner*—Joseph R. Taylor
*Attorney, Agent, or Firm*—Abraham A. Saffitz

[57] ABSTRACT

An arrangement of modular elements comprising a balance beam having a narrow top rail and trapezoidal base with steep sides giving the illusion of shallowness adapted by connecting means to be used together with one or more cylindrical pedestals each having a well and a recessed disc seated in said well which serves to carry a message and acts as the target or destination of a child walking the rail along a roughened strip longitudinally extending the length thereof, the child sensing the strip by the sense of touch through the bottom of his feet.

7 Claims, 19 Drawing Figures

Fig. 1.
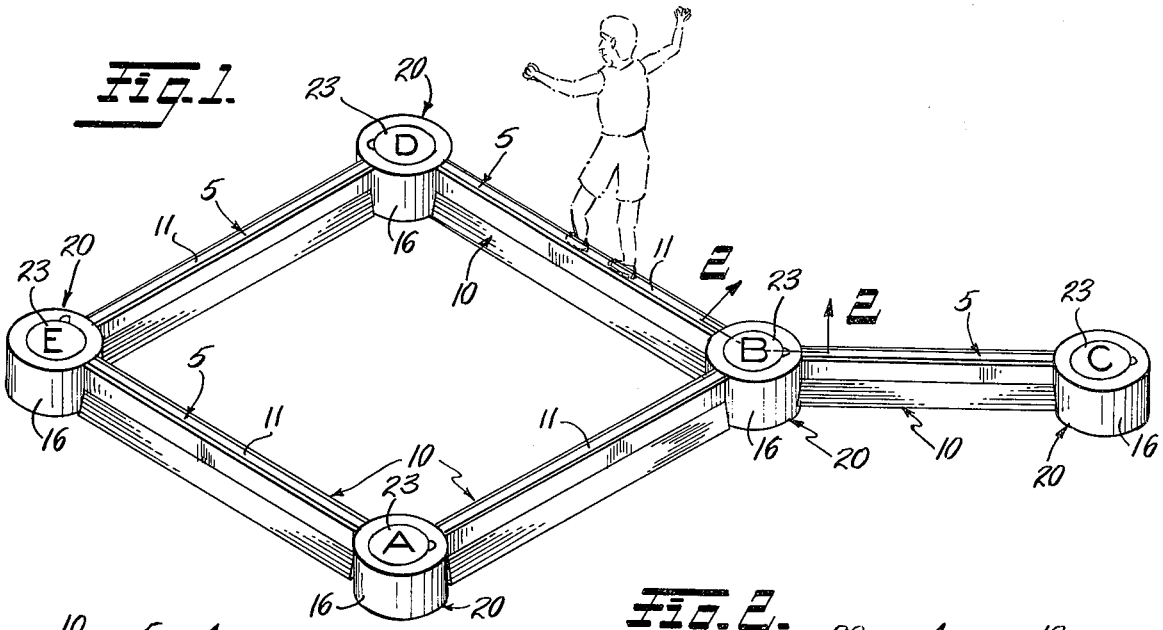
Fig. 2.
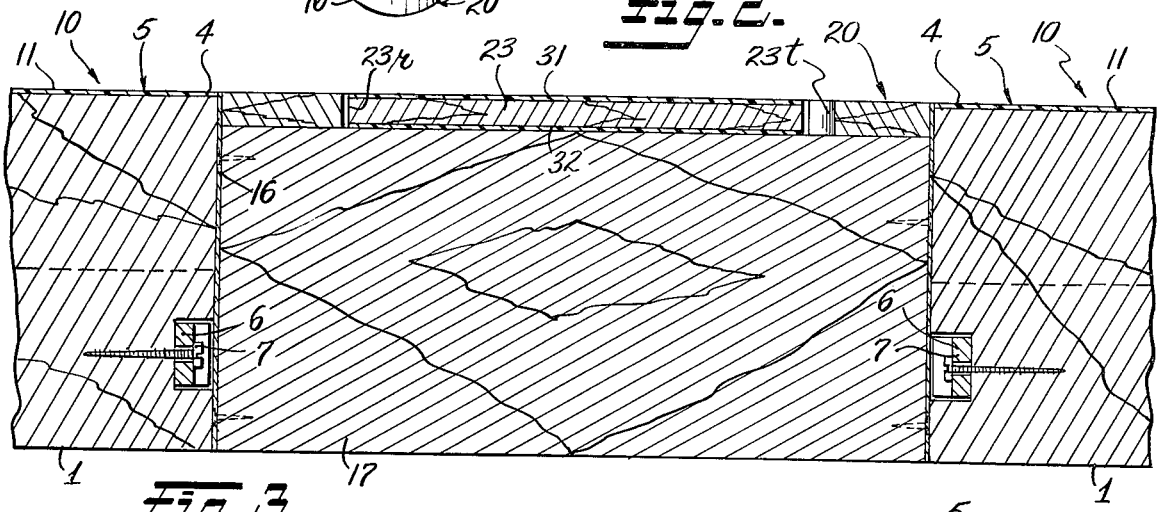
Fig. 3.
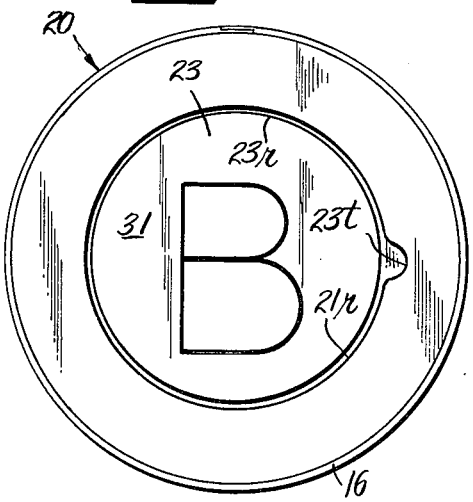
Fig. 4.
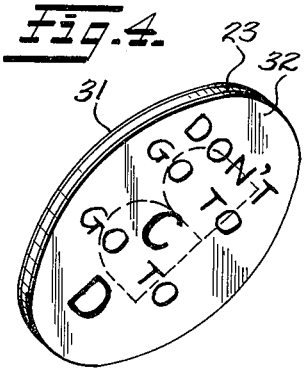
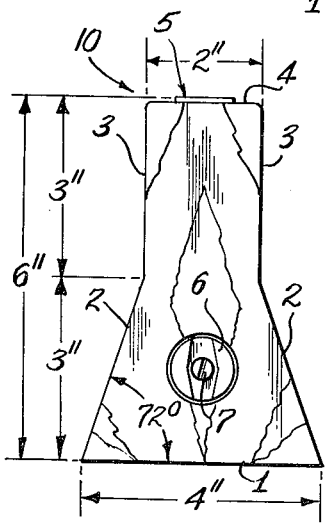
Fig. 5.

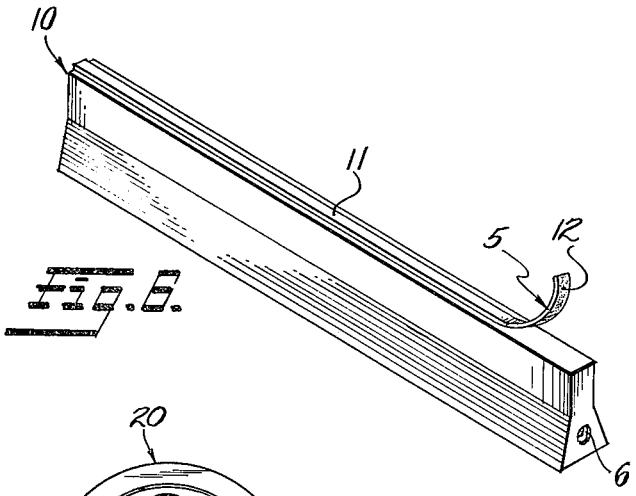
Fig. 6.
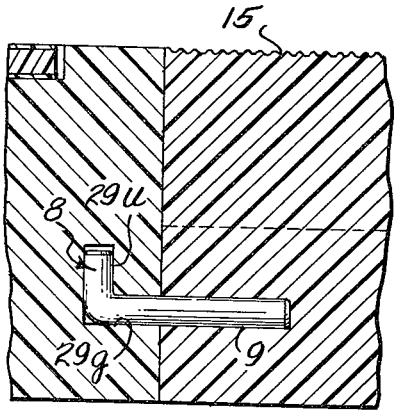
Fig. 8.
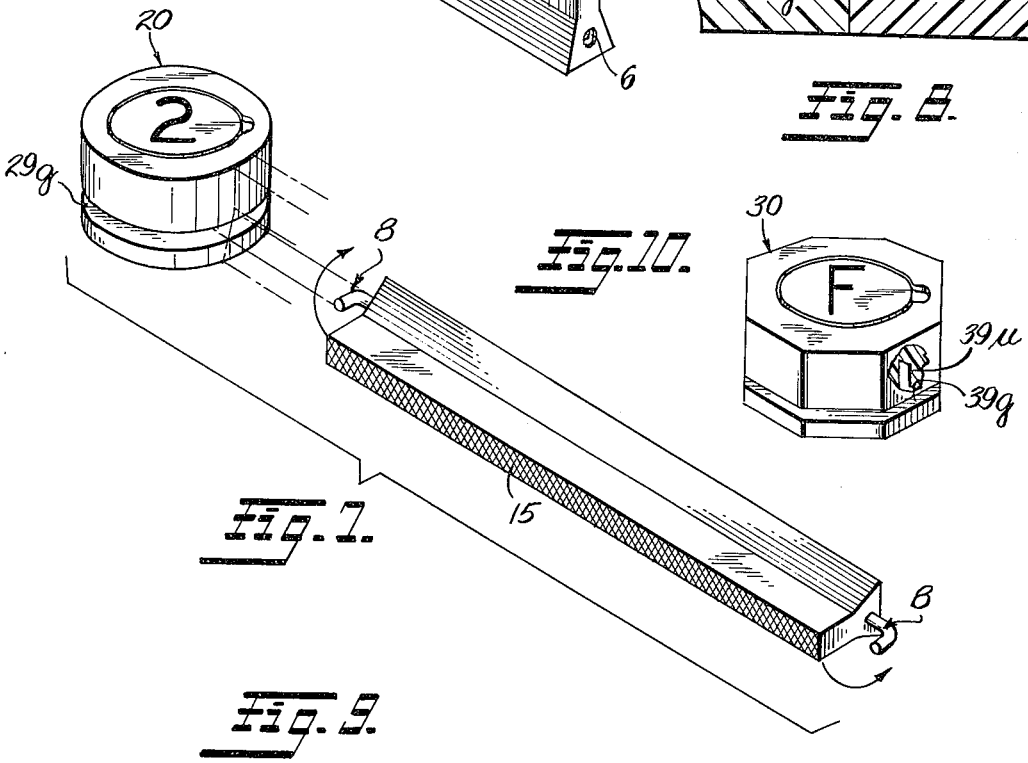
Fig. 10.
Fig. 7.
Fig. 9.
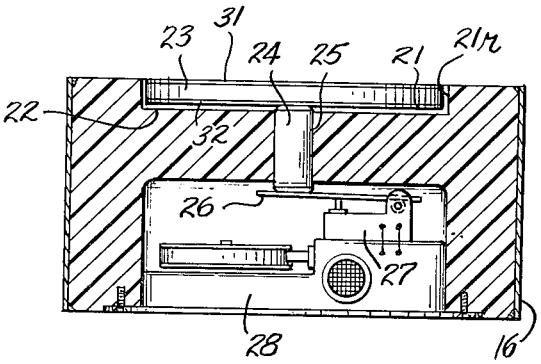
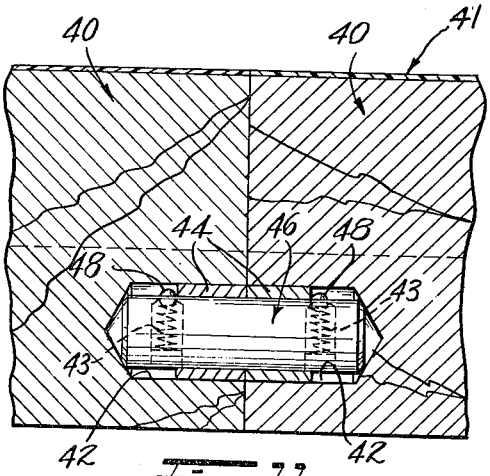
Fig. 11.

BALANCE BEAM TRAINING APPARATUS

FIELD OF THE INVENTION

The present invention relates to educational devices for children from pre-school age through the elementary grades for improving their perception, coordination and attentiveness through physical exercise.

DESCRIPTION OF THE PRIOR ART

Footlik in U.S. Pat. No. 3,589,716 has proposed a balance beam for training children suffering from dyslexia and other learning disabilities in which the beam is constructed in a manner so as to wobble and make it a little difficult to walk the beam either on a level or on an incline.

It is known that the training of children on a balance beam for improving coordination can aid learning in reading, spelling and speech and can also improve other motor responses involving coordination with sensory stimuli and perception induced thereby involved in the assimilation of perceptual educational material. See Moritz, U.S. Pat. No. 3,339,920, issued Sept. 5, 1967.

The raising of the beam or the tilting thereof creates tension and anxiety in the child who walks the beam. See for example the beams used by experienced gymnasts in Sorenson et al, U.S. Pat. No. 3,404,884 issued Oct. 8, 1968 or the rocking beam of Pitkanen, U.S. Pat. No. 3,485,493 or the tilted beam of Lowman, U.S. Pat. No. 1,747,721.

In none of these prior art balance beams is there used a straight beam giving the illusion of shallowness due to the color of the beam and the specific and critical details of construction of the tapered base of the beam in its relation to the narrow rail portion nor is there provided a running length of narrow line or band extending along the entire length of the rail to provide both a visible line pathway which can be simultaneously seen and felt through the bottom of the child's feet (stocking feet or bare feet or with light sneakers, slippers or shoes).

SUMMARY OF THE INVENTION

The present invention utilizes the novel principle of a balance beam of substantial height having bottom and side portions of trapezoidal shape to give the illusion of shallowness and a flat rail top portion having a narrow roughened light colored band which can be felt by the bottoms of the child's feet while he walks the rail along a stable path provided by the band while the beam is resting on a flat surface. Thus the child walks on a narrow rail following a colored central line one foot in front of the other, simultaneously seeing and feeling his way by the soles of his feet (stocking feet, slippers, etc., or barefooted) from the start at one end of the rail to the finish at the other end of the rail.

To aid training and play, the invention provides joining means on the beam to connect to a cylindrical pedestal serving as a target placed at the end or at both the beginning and at the beam end, the pedestal being at the same height as the rail so that the child can step up to the pedestal if he is starting to walk the rail or step down from the pedestal after he has finished walking the rail, or both.

By dtilizing the various primary colors or pastel shades for the beams, the child's perception of color of the beam, color of the rail band and color of the pedestal may all be tested as variables conditioning the child's perception and performances and by using an instructor disc provided in a well of the pedestal, instructions may be marked on the surface of the disc to permit a programmed course of instruction and play.

In another aspect of the invention red and green shades may be used for the solid color of the beam and the color of the walking tape which is adhered to the rail so that pupils who are color blind to red and green may be exposed to a walking test on the rail and can see different shades of grey.

A still further embodiment of the invention, the beam may be colored black, placed on a black floor rug or surface, and the pupil required to walk along a white or light yellow walking tape adhered to the rail. The black of the beam blending with the black of the floor will permit the pupil while looking down to concentrate on the white line and he will not get the illusion of height by looking down unless he looks out and notices that he is at least 5 or 6 inches above the ground.

In still another embodiment of the invention the target pedestal may be joined to the beam by mechanical means, for example, a curved connecting beam which is seated in an end of the beam and engages through a groove an inner wall at the base of the target pedestal.

The target pedestal may preferably be cylindrical or octagonal in shape, both of these shapes permitting a right angular path as well as a straight path both to the pedestal and from the pedestal, e.g. the pedestal in both of these shapes serves as a center point of the cross rods or cross paths and thereby permit choices to be made by the pupil in response to indicia instructions on the instructor disc sitting in the well of the target pedestal or by the sound of an audio tape machine which is activated by a pin movement when the pupil steps on the disc and moves the pin against a lever which starts an audio tape machine to play programmed oral instructions. The oral message may be used to supercede the written message and this can be used in a game which trains decision making by the pupil.

The unique angular instruction at the base of the trapezoid provides stability and safety. Small children have more difficulty than larger children in walking the rail. The length of the rail at about three feet makes for a length of balancing path which is a challenge for the small pupil yet presents no hazard when the child falls to one side since his feet will strike the acute trapezoidal sides only a few inches from the floor and his depth perception will be such that by looking straight down he will feel himself to be much closer to the floor when he looks straight down than when he looks straight out; by looking straight out he will feel himself to be a 6 inch height above the floor but by looking straight down it will appear only a few inches to the floor. The length of the path which is a challenge to the older child if it is increased may be adjusted in accordance with the invention by using beam connecting means to join to short beams together with, e.g. a 6 foot path instead of a 3 foot path or a 9 foot path if desired.

In a preferred embodiment there is provided a beam having a narrow rectangular top rail portion and a base portion of trapezoidal cross section, the trapezoidal section being about one half the height of the beam, each acute angle of the trapezoidal base portion being the same and being between about 70° – 75° to thereby provide an illusion of shallowness to a child walking the beam, a cylindrical pedestal of the same height as said beam having a well in its upper surface, a recessed disc seated in said well, indicia on said surface of said disc to carry a message to a child walking the beam and connecting means at an end of the beam, said connecting means adapting the beam to be joined to said pedestal of like height.

OBJECTS OF THE INVENTION

An object of the invention is to provide a balance beam of substantial height having bottom and side portions of trapezoidal shape to give the illusion of shallowness and a flat rail top portion having a narrow roughened light colored band which can be felt by the bottoms of the child's feet while he walks the rail along a stable path provided by the band while the beam is resting on a flat surface.

A further object of the invention is to provide joining means either magnetic or mechanical on the balance beam to connect to a pedestal serving as a target placed at the end or at both the beginning and at the beam end, the pedestal being at the same height as the rail so that the child can step up to the pedestal if he is starting to walk the rail or step down from the pedestal after he has finished walking the rail.

A further object of the invention is to use various primary colors or pastel shades for the beam, so that the child's perception of color of the beam, color of the rail band and color of the pedestal may all be tested as variables conditioning the child's perception and performance and by using an instructor disc provided in a well of the pedestal, instructions may be marked on the surface of the disc to permit a programmed course of instruction and play.

Another object of the invention is to provide a target pedestal, preferably cylindrical or octagonal in shape, both of these shapes permitting a right angular path as well as a straight path both to the pedestal and from the pedestal, e.g. the pedestal in both of these shapes serving as a center point of the cross rods or cross paths.

Still another object of the invention is to provide mechanically actuated sound instructions played by a tape recorder placed in the base portion of the pedestal to aid in training.

A further object of the invention is to provide novel connecting means for sidewise joining several pedestals to each other, several beams to each other, and several pedestals to several beams.

A further object is to provide dovetail-type means to join longitudinal faces of stable trapezoidal shaped beams to each other for creating an educational toy having widened portions top and bottom.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

In the drawings:

FIG. 1 is a view in perspective showing an exercise or a game in which five (5) beams are associated with five (5) target pedestals in a program where the pupil starts at A, bends down at B, and receives his instructions (see FIG. 4) by lifting up the disc which tells him to go to D not to C; and FIG. 2 is a sectional view along line 2—2 of FIG. 1 which shows the magnetic connection between the magnets at the end of the beam and the metal skirt about the target pedestal; and FIG. 3 shows a top view of the cylindrical form of a target pedestal, and the instruction disc which sits in the well of the target pedestal; and FIG. 4 shows a bottom view of the instruction disc per se, which was picked up by the pupil at target B; and FIG. 5 shows an end view of the beam and gives dimensions of the beam as well as a magnetic attaching means in a face of the end of the beam; and FIG. 6 shows a perspective view of the beam with an adhered tape on the rail marking the center line of the beam for the walking path; and FIG. 7 shows a modification of the beam adapted to mechanically interfit by means of curved connecting pins to an inner wall adjoining in a groove in the bottom portion of the target cylinder; and FIG. 8 shows an alternative embodiment in a sectional view of the mechanical connector of beam and target pedestal. FIG. 8 also shows a surface 15 instead of a tape; and FIG. 9 shows a modification of the target pedestal in which the disc rests on a movable pin actuating a lever and switch of a tape audio player to provide oral instruction when the disc depresses the pin under the weight of a child who stands on the disc; and FIG. 10 is a modification of the shape of the target disc showing an octagonal shape pedestal with parts broken away in sectional views showing the mechanical connecting of the curved pin connector between the beam and the pedestal; and FIG. 11 shows an elevational view, partly in section, of an alternate embodiment of connector different from that in FIG. 8, e.g., a straight connector comprising pin and sleeve members for joining a plurality of beams, end to end.

DESCRIPTION OF THE PREFERRED EMBODIMENT

Figure 12:
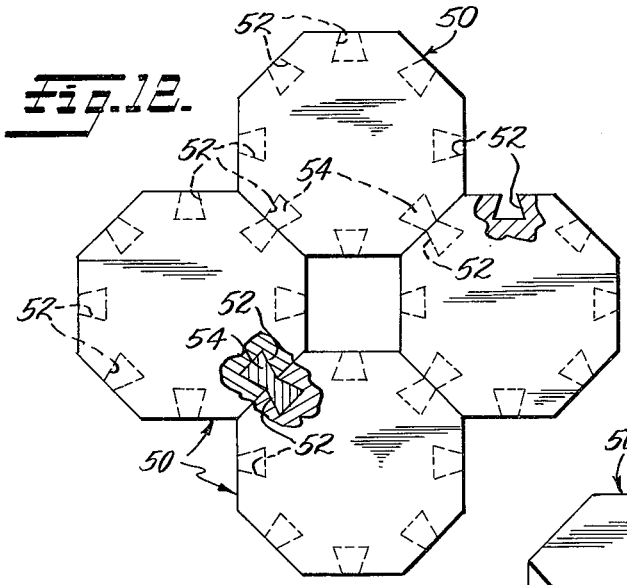
FIG. 12 shows a plan view of a plurality of pedestals joined by a modified connector means.
Figure 13:
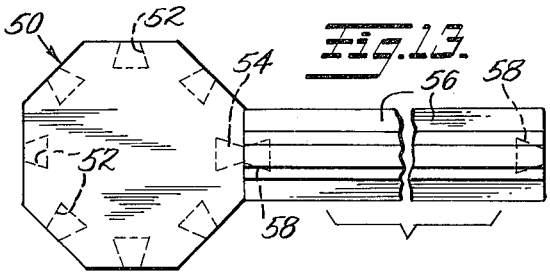
FIG. 13 shows a fragmentary plan view of a pedestal and beam joined by the modified connector means as in FIG. 12.

The magnetically connected assembly of five target pedestals, each designated 20, and five beams, each designated 10, is shown in FIGS. 1 and 2 and the assembly comprises the stable beam 10 connected by magnetic connecting means to the target pedestal 20 with the beam securely resting on its widened base to present a narrow rail top portion 4 viewed by the child from above, for walking along the walking tape 5, so that when the child is walking the narrow beam surface 3, he has a visual impression of walking a line represented by the tape and feels that he is walking on the floor rather than 6 inches above the floor.

The connecting means, which is utilized in the embodiment of FIGS. 1 – 5, is magentic means 6 held at the side of the beam near the base between the widened trapezoidal surfaces 2 by means of a retainer 7.

The educational play under the supervision of the teacher, which is illustrated in FIG. 1, shows the child walking between the target marked B, on disc 23, and target marked D on the disc. At this stage in the training exercise, the child is successfully walking the tape between B and D, and the child, when he was at station B he was able to lift up disc 23 by inserting his finger into recess 23, lifts up the disc, turns it over, and reads the instructions on the back of the disc, which says, "Don't go to C, go to D".

For the purposes of illustrating training, the child had started at A, walked the rail to B, had taken his instructions at B, and had made a choice to go to station D. The cylindrical pedestal 20, used at station B, illustrates a magnetic joining of 3 beams, 2 of which are at right angles to each other, and all of the other stations D, E, and A of the closed path have 2 beams.

The play and instructional possibilities can be widely varied because the variety of connecting means between the pedestal and the beam, the magnetic connecting means being useful for older children who could kick the beam away from the magnet holding means and are responsible enough to restore the connection without frustration and to program the hook connecting means of FIG. 7, the pin connecting means of FIG. 11, and the dovetail connecting means of FIG. 12 permit a greater variety of pedestal arrangements contributing to safety and ease of movement of the child. Four pedestals 50, of octoganal shape, can serve as a widened target platform in a similar arrangement to FIG. 1 to replace the cylindrical pedestal 20 and to afford a totally different type of connecting means in directions which move outwardly from the side faces of the octagons in comparison with the cylindrical faces 16 of the circular target pedestal 20.

Figure 18:
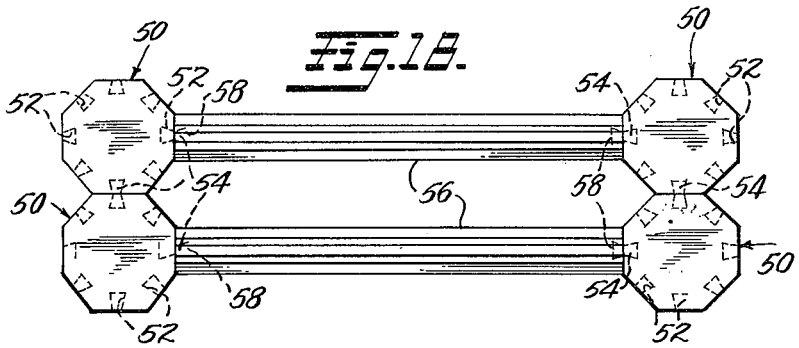
FIG. 18 is a plan view of a parallel bar walking arrangement utilizing two beams and joined octagonal pedestals by means of the modified connecting means of FIGS. 12 – 15.

Thus, double beam arrangements may be achieved with the octagon pedestal as shown in FIG. 18 and with the child's participation in making the connections between the pedestal and the beam is a valuable part of the training exercise emphasizing physical activity.

In the embodiment shown in FIGS. 6, 7 and 8, a hook means 8 serves as a mechanical connection between the beam 10 and the pedestal 20.

This mechanical connection by the hook means which is shown in section in FIG. 8 illustrates a hook 8 which is integrally connected within a bore 9 of the beam 10 at its straight portion and at its free hooked portion 8 engages within a curved recessed portion in the pedestal **39*g* and locks in the upwardly extending recessed portion 39*u*, to be firmly attached to the pedestal by insertion and twisting to the locked position. The insertion of the hook 8 into the recess at the bottom part of the side of the pedestal 30 is shown in FIG. 10 and is visualized by the arrows showing turning movements and the relationship of the curved free part 29*g* and the upstanding free part 29*u* in FIG. 8 in the dotted section representing the bored or recessed parts 39*g* and 39*u***.

The advantages of the hook connecting means 8 over the magnetic connecting means 6 lies in the more secure mechanical connection uniquely provided by the hook. The magnetic means tends, over protracted periods, to loose its strength. Also the beam may be forcibly kicked away to detach from the pedestal and for younger childres the hook means 8 or the dovetail connecting means 54 is preferred.

To see the simplicity of positive connection of the hook, reference is made to FIG. 7, wherein the detachment of the beam from the circular pedestal 20, in exploded view, is shown to demonstrate the clockwise locking motion (arrow at left end) and the counterclockwise opening motion when the free hook portion enters recessed **29*g* at the base of the pedestal 20**.

Figure 16:
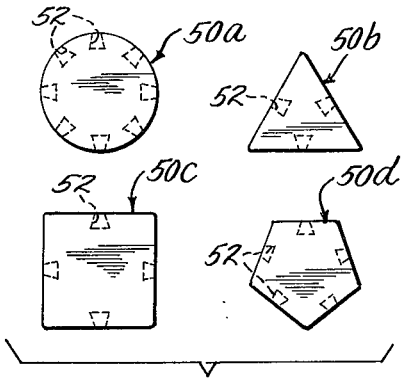
FIG. 16 is a plan view showing an array of regular polygonal pedestals in 3, 4 and 5 side configurations and in a circular configuration, each with mortised sections for reviewing the connecting means as used in FIGS. 12 – 15.

The pedestal means 30 illustrated in FIG. 10 is octogonal in shape rather than circular in plan view as compared to pedestal 20 in FIGS. 1 – 3. In FIG. 16, there is shown a cylindrical pedestal means **50*a* which embodies a different recessed means for engaging connecting means, e.g., a dovetail-type connector for pedestal and beam which is preferred to that means in FIGS. 1 – 3 (magnetic) or FIGS. 8 – 10 (hook means), and this dovetail-type connecting means employed in FIG. 16** permits housing instructions, a treasure in a treasure hunt game, a tape recorder, or other article.

The versatility of the beam-pedestal combinations can be readily recognized by comparing the geometric combinations of FIG. 1 (circular) with those in FIGS. 12, 13, 16 and 18, (octagonal).

Four pedestals 50 are joined by means of dovetail-type connector 54 in recesses 52 there being one recess in each face of the octogon. The octogons may be doubled as in FIG. 18 to provide side by side pedestal means for parallel beam 56.

Figure 14:
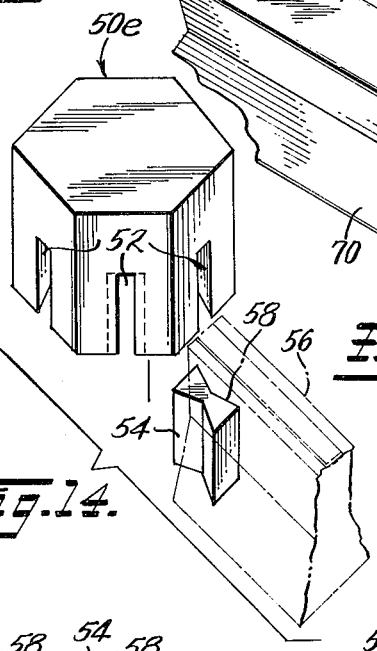
FIG. 14 is an exploded perspective view showing the inter engagement of pedestal, beam, and modified connecting means used in FIGS. 12 and 13.
Figure 17:
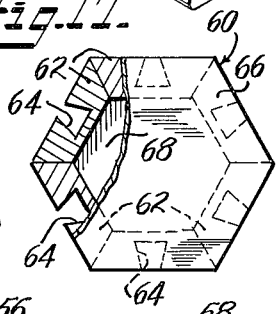
FIG. 17 is a fragmentary plan view partly in section of a hollow embodiment of pedestal suitable for housing a tape recording player.
Figure 15:
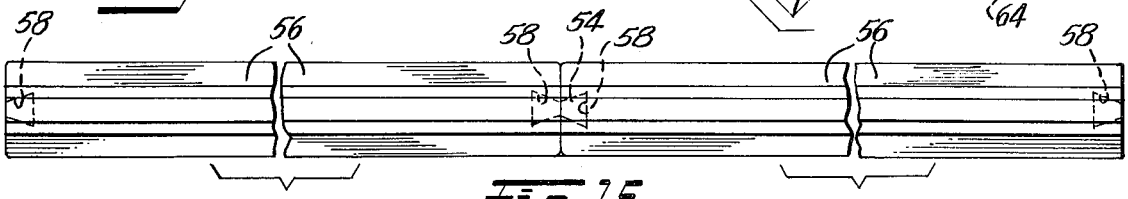
FIG. 15 is a fragmentary plan view showing an end to end arrangement of two means joined by the connecting means as used in FIGS. 12 – 14.

In FIGS. 14 and 16, there are illustrated a choice of circular and polygonal pedestals, e.g. circular pedestal **50*a*, triangular pedestal 50*b*, rectangular pedestal 50*c*, pentagonal pedestal 50*d*, and hexagonal pedestal 50*e*. A preferred series of dovetail recesses, eight in number, permit interchangeability of the octogonal and circular pedestals to permit the play or game shown in FIG. 1** to be played with either shape of pedestal.

The pedestal construction for each embodiment shown permits programmed instructions, the components including written material for the teacher or student teacher, the disc 23, identifying, by indicia on surface 31 a target or destination, and a written message shown in under surface 32. This written message may contain any instructions desired as part of a continuing program.

The preferred beam dimensions have been determined after long experimentation with children varying in age from 2 to 16 years, and are shown in FIG. 5 wherein the walking tape, 1 inch in width, is formed of a pressure sensitive backed brightly colored tape having a resilient, nubby, non-slip surface and available from Minnesota Mining and Manufacturing Company under the tradename "Scotch-Tred," a registered trade mark of this company and is applied to rail 4.

The child perceives the 1 inch tape as a line which is straight from beam end to end, which he follows with his feet and eyes as he walks the rail. The 6 inch height is substantial to a child of 2 – 4 years, since it is generally about 15% of his height, which corresponds to an adult walking one foot above ground level. However, the trapezoidal sides (FIG. 5) ending about 3 inches above ground level with a widened base of 4 inches, gives an illustion of a 1 inch walking line mounted on a 3 inch rail and this gives confidence to the child who need not step down from the pedestal. Simultaneously, there is a feeling of height but safety because of the illusion of shallowness imparted by the beam sides and widened base.

A still further sleeve and pin connecting means is shown in FIG. 11, comprising sleeve 44 integrally mounted in beams 40, the pin 46 being spring loaded with spring means 43 at each end, these being held by detents 48 to permit one of the free ends, either right or left in FIG. 11, to be pushed into the recessed 42 at the end of the beam 40.

This construction permits doubling, tripling, or multiplying the beam length as desired, thereby allowing smaller units to be put together in safety by the child as well as the teacher.

The joined beams 40 illustrated in FIG. 11 may bear a coating of wear resistant synthetic or natural resin material, e.g., polyurethane, polyolefin, alkyd, melamine resin, phenolic resin, lacquer, or other materials desirable by reason of low toxicity, low cost, and ease of application and repair. The coating may contain grains of sand, emory, or the like.

In the frictional surface 15 formed at part of the upper rail, the beam in FIG. 8, the non-slip characteristics are provided by embossing the surface of plastic material, synthetic, rubber, or plastic, so that the child may walk the beam safely.

The preferred material for long units, about 3 feet in length is wood and the preferred materials include:

| | |
|---|---|
| Balsa Wood (FIG. 2) | White Pine (FIG. 2) |
| Structural Plastic Foam | Redwood (FIG. 2) |
| Fiberglass Reinsorced Polyester Resin | |
| Cycolac Plastic (ABS) (Marbon Plastics) | |
| Rigid Molded Polyurethane Materials | |

An important educational advantage of the invention is provided in the pedestal means of FIG. 9 by the disc actuated tape recorder means or other sounding means combining sound instructions or signals with the written indicia and instructions placed on disc 23 or disc 23 recessed portion. The teacher or child may flip the disc to expose the under message by finger or thumb grasping the disc edge at aperture 23 as shown in FIGS. 3 and 4. In the embodiment of pedestal of FIG. 9, the weight of the child on disc 31 presses against and moves free floating pin 24 against lever arm 26 to thereby actuate tape player 28 by tripping switch 27, and thereby emitting sound, voice or other signals to impart a teaching instruction to the child.

The sound unit may be mounted on a base and removed as a unit after detaching the mounting screws as shown in FIG. 9.

Briefly summarizing magnetic and mechanical connecting means simple in construction, yet easy to operate by teacher or child have been disclosed in the preferred embodiments herein and a great variety of beam to beam, pedestal to beam, and pedestal to pedestal arrays are provided to challenge the creativity of the child and to promote visual motor and perceptual skills as part of the child's total development and growth.

Figure 19:
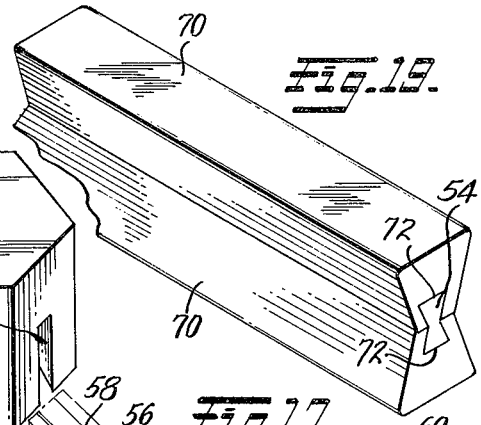
FIG. 19 is a perspective view of a crawling beam having rounded edges for use by an infant, and formed of two trapezoidal beams joined at their narrow face by connecting means similar to that in FIGS. 12 – 15.

A combination face-abutting double beam educational development and play toy embodiment is illustrated in the alternate embodiment of FIG. 19, which toy may be used with or without a pedestal. There are four play or instructional surfaces. This embodiment of double beam employs the dovetail-type connector 54 in the top surface of each trapezoidal half 70 and the connector is inserted at each end face into recess 72. It is contemplated that a child will crawl on the beam and will pass decals, puzzles, symbols, instructing sounding parts as part of a game emphasizing discovery perception and tactile tasks, using all of the limbs. By separating the beams, the child can practice straddling both beams at a lower height preferably at 3 inches and try to negotiate the entire length preferably about 30 inches. Obviously, this embodiment may incorporate the sounding tape device of FIG. 9.

What is claimed is:

1. A modular arrangement of a beam element, a pedestal element of like height, connecting means joining these elements, said beam element being of uniform cross section throughout its length having a narrow rectangular top rail portion and a base portion of trapezoidal cross section, the trapezoidal section being about one half the height of the beam, each acute angle of the trapezoidal base portion being the same and being between about 70° – 75° to thereby provide an illusion of shallowness to a child walking the beam, said pedestal element having a recess in the side to accommodate said connecting means, and comprising a body having a well in its upper surface, a disc in said well bearing indicia and an aperture adapting a child to pick up the disc and see indicia on either surface.

2. A modular arrangement as claimed in claim 1 wherein said pedestal is circular in top plan view.

3. A modular arrangement as claimed in claim 1 wherein said pedestal is triangular in top plan view.

4. A modular arrangement as claimed in claim 1 wherein said pedestal is rectangular in top plan view.

5. A modular arrangement as claimed in claim 1 wherein said pedestal is pentagonal in top plan view.

6. A modular arrangement as claimed in claim 1 wherein said pedestal is hexagonal in top plan view.

7. A modular arrangement as claimed in claim 1 wherein said pedestal is octogonal in top plan view.

* * * * *